US005565032A

United States Patent [19]

Wyner

[11] Patent Number: 5,565,032

[45] Date of Patent: Oct. 15, 1996

[54] APPARATUS FOR LONG-RANGE PRESERVATION BY LIQUID-AIR INJECTION INTO POROUS STRUCTURES - ROADS, BRIDGES, BUILDING, INFRASTRUCTURE AND EMBEDDED STEEL MASONRY

[76] Inventor: Jay S. Wyner, 69 Barkers Point Rd., Sands Point, N.Y. 11050

[21] Appl. No.: 566,696

[22] Filed: Dec. 4, 1995

Related U.S. Application Data

[63] Continuation-in-part of Ser. No. 243,178, May 16, 1994, abandoned.

[51] Int. Cl.[6] ..... B05B 7/16

[52] U.S. Cl. ..... 118/63; 118/315; 222/617; 239/418; 239/424

[58] Field of Search ..... 239/135, 419, 239/423, 151, 754, 418, 424; 222/630, 638, 608, 617, 146.2; 118/300, 315, 63; 422/7, 9; 261/115, 118

[56] References Cited

U.S. PATENT DOCUMENTS 3,987,964 10/1976 Pittman et al. ..... 239/754 X
4,204,495 5/1980 Wyner ..... 118/300
4,395,457 7/1983 Wyner ..... 118/300 X
4,448,818 5/1984 Hartog et al. ..... 118/300 X

*Primary Examiner*—Robert Warden
*Assistant Examiner*—E. Leigh Dawson
*Attorney, Agent, or Firm*—Nathaniel Altman

[57] ABSTRACT

Apparatus for preserving porous structures, including masonry structures with embedded structural steel or reinforcing steel elements, applies a liquid preservative material to an exposed surface of the structure using the force of a compressed air blast at high velocity to meet, atomize, and inject the liquid preservative deeply into the porous structure. Separate manifolds each having multiple spaced nozzles are provided for the liquid preservative and for the air blasts, both manifolds being covered by a shroud. The manifolds and their nozzles are positioned and arranged so that, as the liquid is deposited on the surface of the structure, the high-velocity blast of air, arriving at the same area at the same time, atomizes, injects and forces the liquid into the interior of the structure, so as to coat the intersticies of the inner porous structure, including any reinforcing steel therein, the high-velocity air blast acting as a fluid hammer. A carrier for the apparatus is provided for moving it along the surface being treated. The preservation of structures occurs without the need of disturbing, breaking open or repairing brick, concrete, masonry, stone or even wood structures.

19 Claims, 2 Drawing Sheets

FIG. 1
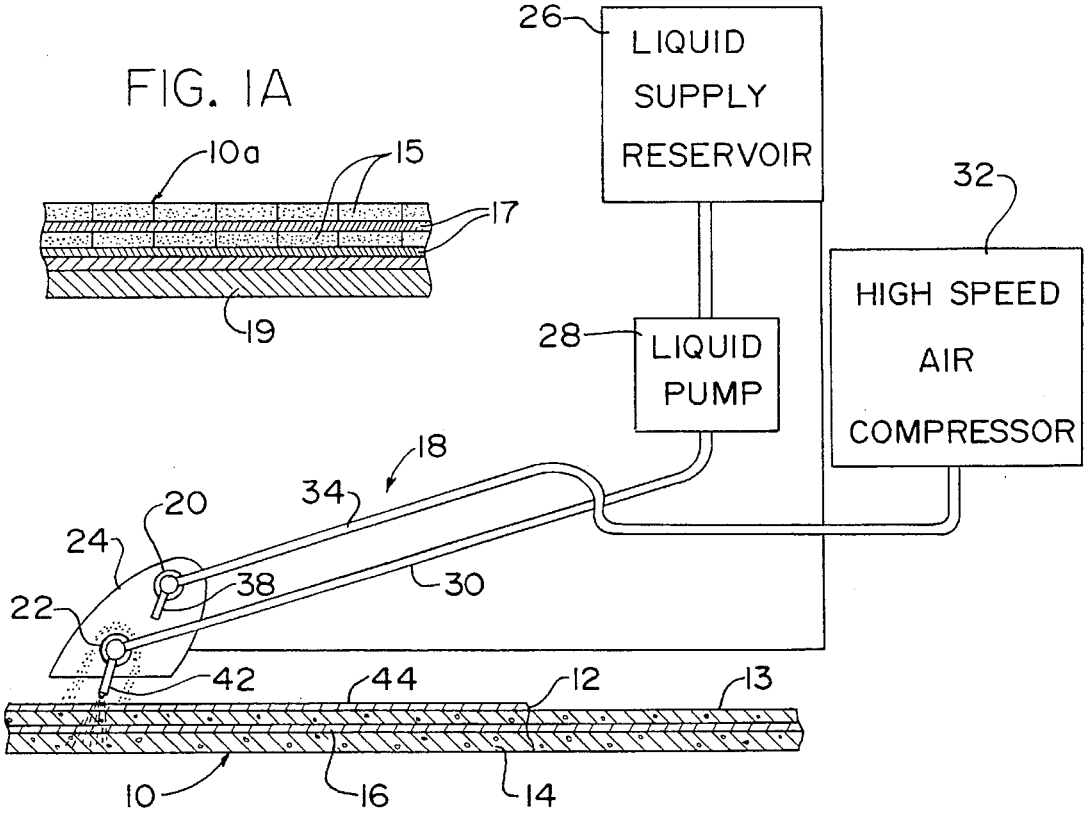
FIG. 1A
FIG. 7
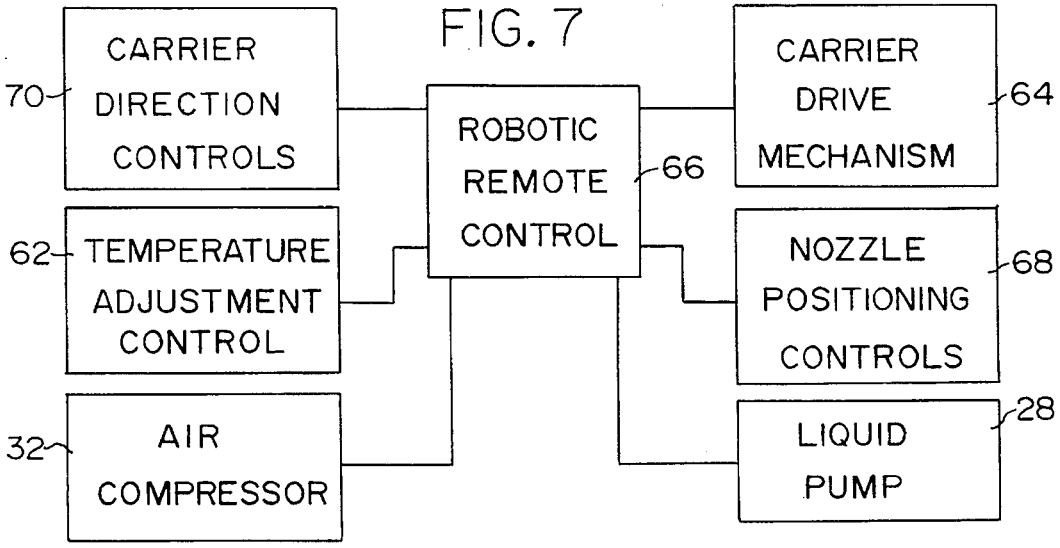

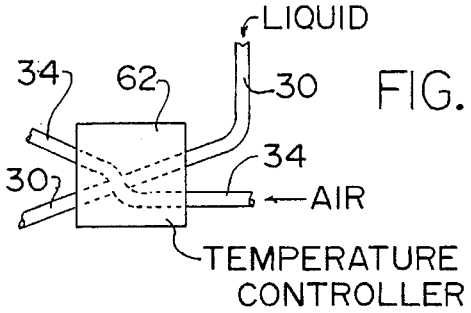
FIG. 5
FIG. 6
FIG. 2
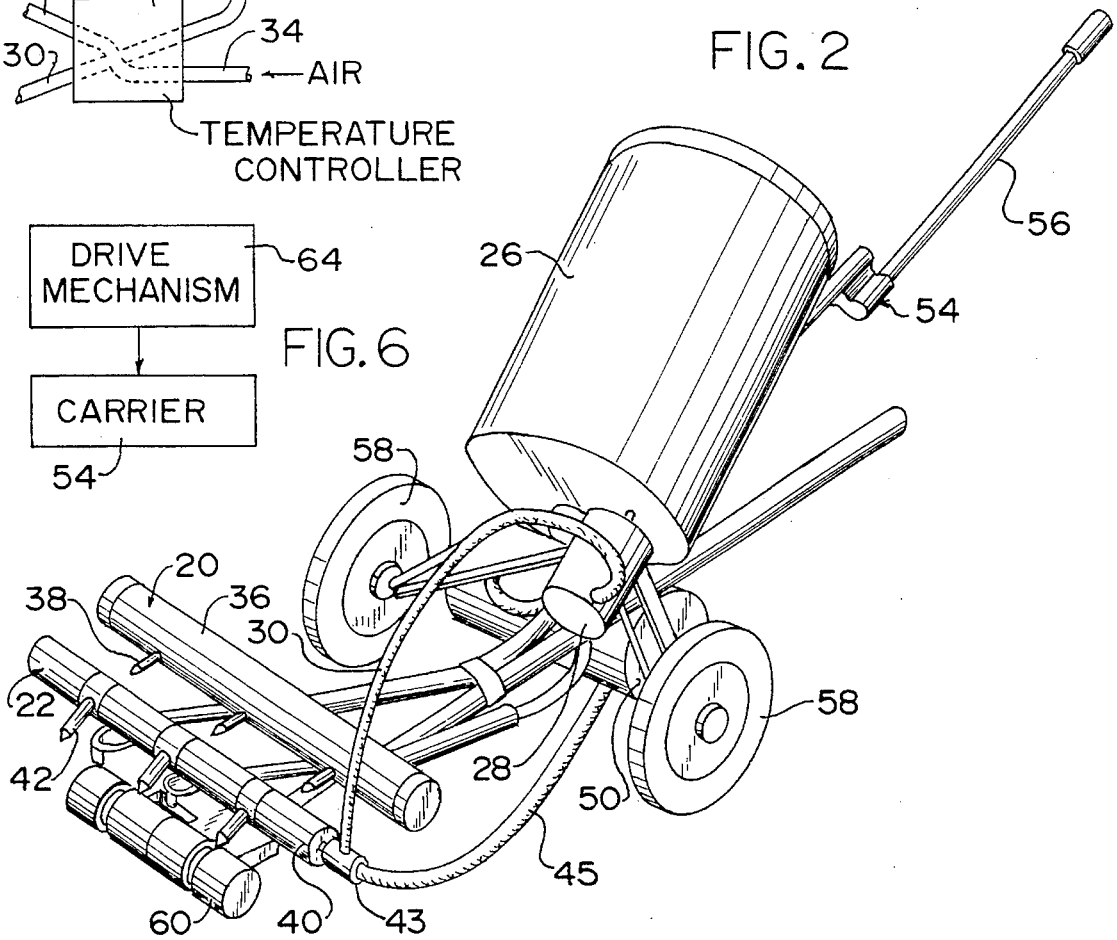
FIG. 3
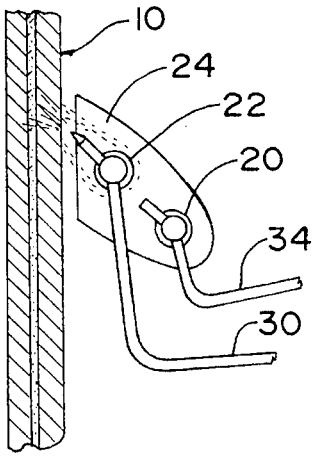
FIG. 3A
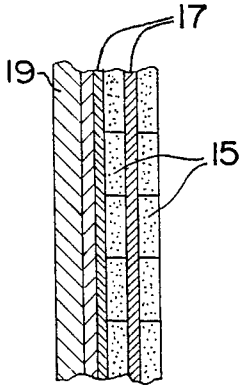
FIG. 4
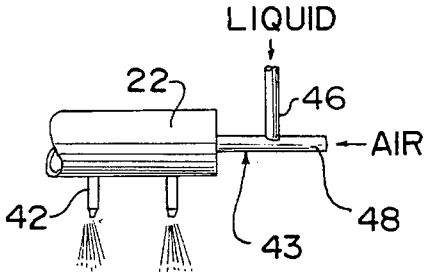

APPARATUS FOR LONG-RANGE PRESERVATION BY LIQUID-AIR INJECTION INTO POROUS STRUCTURES - ROADS, BRIDGES, BUILDING, INFRASTRUCTURE AND EMBEDDED STEEL MASONRY

This is a continuation-in-part application of U.S. patent application Ser. No. 08/243,178, filed May 16, 1994, to be abandoned, and derived from the parent application which resulted in U.S. Pat. No. 5,413,808, issued May 9, 1995. The parent application was restricted to method claims; the present application is directed toward the novel non-elected apparatus for carrying out therewith the method of the parent case.

Field of the Invention

This invention pertains to the long-range preservation of porous structures made of concrete, masonry, stone and wood, particularly concrete and masonry structures having reinforcing steel members embedded therein, by independently applying a suitable liquid preservative material to the surface of the porous structure and utilizing high-velocity compressed air blasts separately but simultaneously reaching the surface to force the liquid preservative into the structure.

BACKGROUND OF THE INVENTION

Porous structures of concrete, masonry, stone and wood, including buildings, roads, bridges, tunnels, monuments, sculptures and other outdoor art works are exposed to the deleterious effects of multiple environmental hazards. Attack by acid rain, salts, extreme temperatures and various atmospheric pollutants causes gradual but persistent deterioration in these structures. The presence of commonly used reinforcing steel members embedded in most of these porous structures increases the damage and deterioration created by corrosion and oxidation of the steel following erosion of the surrounding masonry, all caused by the airborne pollutants in today's atmosphere. These pollutants, acid in character, easily penetrate and react with the lime salts present in all masonry, the result being slow and constant erosion, cracking, crumbling and eventual collapse of the exposed porous structures.

Presently used methods of preservation have provided short-term protection, at best. Waterproofing materials, protective compounds and paints, when applied to structures by standard brush, spray or roll-on methods, achieve only shallow penetration by capillary action; a single coat is insufficient, and a second coat tends to clog the porous structure's breathing passages, as reported in National Bureau of Standards Technical Report No. 1118. With the surfaces of the porous structures clogged and sealed in this manner, internal stresses and pressure develop within the structures, created by the effect of thermal changes on the ever-present moisture in masonry; as a result, the trapped vapor pressure generated thereby breaks through, cracks, delaminates and destroys the protective coating.

Numerous other methods have been used in attempts to preserve porous structures of concrete or masonry. One method is to break open the structure, clean the rusted reinforcing steel, repaint or replace the steel where necessary, then repair the outer masonry or concrete structure. Another method is to drill holes in the structures where reinforcing steel members exist, apply a preservative material with a gun applicator under manual or pump pressure, then refill and repair the masonry. Still another method used on roadbeds involves cutting elongated slots or grooves, filling the slots or grooves by gravity with liquid preservative material, which may or may not reach the reinforcing steel, thereafter filling the slots or grooves with roadbed coating material. Electrical anodic treatment has also been used, also requiring the breaking open and repairing the concrete. The above preservation methods are slow and costly processes, and on roads are also inconvenient to travelers during such repairs.

In the case of wood preservation, the current application of paint, shellac, epoxy or urethane resins to wood surfaces results in protection which lasts from a few seasons to a year or so before the need arises for scraping and sanding the treated surface and repeating the coating application; damage to the original coating results from the shallow penetration and sealing effect of applications made by brush, roll-on or spray. The cellular resin structure of wood tends to cause a chemical migration in the wood when thermal expansion stresses, such as hot and cold weather spells, are imposed. In the summer, the expansion stresses cause these coatings to expand as a result of forces emanating from the wood's cellular resins; in the winter, the contraction stresses cause these coatings to crack and peel, allowing moisture, acid rain and pollutant intrusion to cause "lift-off" of the coatings when freeze-thaw cycles occur. Thereafter, moisture- and pollutant-absorption into the wood fibers accelerates wood decay.

The prior art discloses some presently used methods and apparatus for preservation of porous masonry walls; among them are U.S. Pat. No. 4,204,495 to Wyner disclosing the design of a high-speed pulsating air device, and U.S. Pat. No. 4,395,457, also to Wyner, dealing with the thermal insulating effect achieved by entrapment of the air cells existing between masonry particles, thereby creating a multi-barrier thermal insulating system that prevents heat or cold from escaping through the walls of a masonry structure, thus reducing high energy consumption and fuel costs. Also, U.S. Pat. No. 4,153,743 to Caramanian and U.S. Pat. No. 4,342,796 to Brown disclose surface treatments of concrete with sealant materials, but without injecting the sealant into the porous structure.

SUMMARY OF THE INVENTION

The present invention provides novel apparatus for the long-range (30–40 years or more) preservation of porous structures such as concrete, masonry, stone and wood, including those structures above and below ground having steel reinforcing members embedded therein, without the need for breaking open, destroying or repairing any part of their vertical or horizontal surfaces. The method comprising one or more liquid preservative materials such as polymeric resins being applied to the surface of a porous structure independently and using one or more blasts of high-velocity compressed air to meet and force the liquid preservative material into the porous structure to selected depths, accomplished by adjustment of the viscosity of the liquid material and the velocity and duration of the compressed air blasts.

Apparatus for practicing the above method of injecting liquid preservative material into porous structures, including steel-reinforced concrete, masonry and infrastructure, comprises separate manifolds, each with spaced nozzled orifices, for the independent directing and delivering of liquid preservative and compressed air to the same area of structure surface at substantially the same time. These paired manifolds are positioned within a shroud and mounted on a carrier, together with liquid and air supply means thereon as well; liquid-air injection is achieved by moving the carrier by motorized or manual means over the surface being treated, with the liquid preservative material being deposited on any given surface area separately but being met substantially simultaneously with the highly compressed air blast acting as a hammer to inject and drive the liquid to a preselected depth into the porous structure.

The apparatus of this invention will be described in full detail in connection with the accompanying illustrative but not limiting drawings, wherein:

SHORT FIGURE DESCRIPTION OF DRAWINGS

FIG. 1 is a diagrammatic view showing the essential parts of the apparatus of this invention as arranged for treating a reinforced roadbed structure shown in cross-section:

FIG. 1A shows a cross-sectional view of another porous reinforced structure, a building wall;

FIG. 2 is a perspective view showing one preferred embodiment of the apparatus of this invention;

FIG. 3 is an elevational view of a portion of the apparatus of this invention in use for treating a vertical wall shown in cross-section;

FIG. 3A is a cross-sectional view of a vertical wall of another type of porous structure;

FIG. 4 is a partial elevational view of a liquid application manifold of the apparatus of this invention;

FIG. 5 is a partial diagrammatic view of a device for controlling the temperature of both liquid and air components used in the invention;

FIG. 6 is a schematic view of a drive mechanism for moving the carrier of this invention; and FIG. 7 is a schematic view of a robotic remote control device for operating the various elements of the apparatus by programmed automation.

DESCRIPTION OF THE PREFERRED EMBODIMENTS

As generally shown in FIG. 1, a masonry structure 10, herein shown as a roadbed, comprises an asphalt layer 12 covering a concrete base 14, or just solid concrete 13, all reinforced with elongate steel rods 16. FIG. 1A shows a masonry structure 10*a*, here a portion of a building wall comprising two courses of brick 15, joined by mortar 17 and strengthened by a structural reinforcing member 19 such as a steel I-beam, angle, rebar, etc. Apparatus 18, for injecting liquid preservative deeply into porous structures, comprises a compressed air manifold 20 and a liquid manifold 22, which are covered on all but one side by a shroud 24. Liquid preservative material is delivered to liquid manifold 22 from liquid supply reservoir 26, by way of pump 28 and tubing 30. Compressed air at high velocity is delivered to air manifold 20 from air compressor 32 through tubing 34.

As shown in FIG. 2, air manifold 20 is formed from an elongate pipe 36 having a plurality of outlet nozzles 38 spaced laterally from each other along the length of pipe 36. Similarly, liquid manifold 22 is an elongate pipe 40 having a plurality of outlet nozzles 42 spaced laterally from each other along the length of pipe 40. The ends of pipes 36 and 40 are closed except for inlet device 43, mounted on the inlet end of pipe 40.

As best seen in FIG. 1, the manifolds 20 and 22 and their respective outlet nozzles 38 and 42 are arranged with respect to each other to enable compressed air from outlet nozzles 38 to impinge at high velocity on the liquid preservation material deposited from outlet nozzles 42 in the same area of surface 44 of structure 10 at substantially the same time. Prior to the instant of contact at surface 44, liquid preservative and high-velocity compressed air are separate and unmixed. The high-velocity compressed air from nozzles 38 of manifold 20 is directed to flow around pipe 40 in order to reach surface 44 without blending with the liquid: at impact, however, the blasting high-velocity compressed air acts as a fluid hammer to drive the thereby-atomized liquid preservative and inject it deeply into the pores of the structure being treated.

FIG. 4 illustrates inlet device 43, comprising a T-shaped member having a liquid inlet branch 46 and a low-pressure air inlet branch 48. Air from compressor 50 (FIG. 2) may be passed via tube 45 through branch 48, if desired, to meet incoming liquid preservative material from branch 46, resulting in a liquid-air stream flowing into pipe 40 of liquid manifold 22 and out from there through outlet nozzles 42. This low-velocity air may be added in this manner to adjust and enhance the flow of the liquid material so that its arrival at the surface being treated is timed to match that of the high-velocity compressed air. The liquid preservative material may also be applied in an airless liquid flow, thereby eliminating the use of tube 45, air inlet 48 and small compressor 50.

As best seen in FIG. 2, the above-described parts of apparatus 18 are preferably mounted on carrier 54, which includes handle 56 and dual wheels 58. By this means, apparatus 18 may be moved along the length of structure 10 to apply liquid preservative material to the structure along its entire length. Manifolds 36 and 40 may be varied in length to accommodate various widths of structures which are to be impregnated with liquid preservative material. Adjusting rollers 60 are provided also to vary the distance between the ends of nozzles 42 and surface 44 of the masonry structure which is undergoing preservative treatment. Compressor 32 may be mounted on carrier 54, but because of its size may be mounted preferably on a separate carrier (not shown).

The method and apparatus of this invention are applicable and adaptable to the preservative treatment of vertical as well as horizontal surfaces, as illustrated in FIGS. 3 and 3A. For example, manifolds 20 and 22 may readily be arranged for portability and manual application procedures, rather than being mounted on wheeled carrier 54, as illustrated in FIG. 2.

FIG. 5 illustrates schematically temperature control device 62, for adjusting the temperature of both the liquid preservative material passing through liquid supply pipe 30 and the high-velocity compressed air passing through air supply pipe 34 to control the liquid viscosity and to meet the specific conditions for the preservative treatment being performed.

Drive mechanism 64 schematically shown in FIG. 6 may be employed as the power means for moving carrier 54, replacing the manual operation of FIG. 2; alternatively, robotic remote control device 66 of FIG. 7 may be programmed and actuated to operate carrier drive mechanism 64, robotic positioning controls 68, liquid pump 28, carrier direction controls 70, temperature adjustment control 62 and air compressor 32. Robotic control 66 may be most useful for the application of liquid preservative, in accordance with this invention, to surface areas difficult if not impossible to reach in person, including concrete and other pipes, tunnels and the like.

Liquid preservative materials suitable for preserving reinforced masonry structures, such as the P-J 200 Series or acrylic resins and RS-22 petroleum blend are available from Perma-Junction Corp. U.S.A., 130 Shore Road, Suite 150, Port Washington, N.Y. 11050.

In the operation of apparatus 18, the manifolds 20 and 22 are moved longitudinally along surface 44 of structure 10, while a continuous supply of liquid preservative material and high-velocity compressed air is delivered separately but simultaneously from nozzles 42 and 38, respectively, to surface 44 of structure 10. The high-velocity compressed air meets the liquid preservative at surface 44, atomizes and injects the liquid into the body of structure 10, thereby coating the surfaces of the interstices of the masonry granules within, as well as coating the surfaces of the structural steel or the inner reinforcing bars of the structure. The high-velocity compressed air, in effect, acts as a fluid hammer, injecting and driving the liquid preservative material into the interior of the structure by a blasting action, which may be delivered as a steady blast or in a pulsating fashion, using the mechanism disclosed in my U.S. Pat. No. 4,204,494, or by a similar mechanism.

For porous structures having relatively uniform granule size and porosity such as brick, concrete, limestone, sandstone and the like, the steady straight air blast for meeting and driving the liquid preservative material is suitable, using an air velocity of 100–165 ft/sec. for a duration of 4–7 seconds, depending on the density and porosity of the structure being treated. Higher pressure may be needed for denser structures, or where deeper penetration is required. However, for masonry or stone structures having random configuration or irregular inner particle size, it is necessary to use compressed air injection forces with air velocities of 200–235 ft/sec. for a duration of 3–6 seconds to hammer and inject the liquid preservative deeply enough to reach reinforcing steel bars embedded 2.5–3.5 inches deep in reinforced concrete such as a roadbed. Higher pressure and longer duration may be required for high-density concrete. For a first application step at ambient temperatures of 45–75 deg. F., the viscosity of the liquid preservative should be low, e.g., Ford No. 4 cup of approximately 20 seconds. The shroud 24 should be maintained in the range of 0.5–0.75 inches above surface 44 of the structure being treated. For a second application, a slightly more viscous liquid (Ford No. 4 cup—32 sec. ) and reduced air velocity of 165–200 ft/sec. for only 3–5 secs. may be used, the liquid material being applied somewhat closer to masonry surface 44. If desired, a third preservative application may be provided by using a higher viscosity liquid (Ford No. 4 cup—45 secs.) and lower air velocity (100–135 ft/sec. ) for 2–4 seconds. The third application liquid would still penetrate below surface 44, which is important in the case of road surfaces to avoid vehicle skidding or direct contact with vehicle tires.

If the ambient temperature falls to between 32–45 deg. F., it is necessary to reduce the liquid viscosity and increase the air velocity forces and time of application accordingly by approximately 10% from those values mentioned above to achieve similar results. However, for higher ambient temperatures in the range of 80–90 deg. F., the opposite changes would be required, i.e., increasing the liquid viscosity and reducing the air velocity and application time by about 10% from those first mentioned above. For new structure surfaces, the liquid viscosties and air velocities should be reduced by approximately 5% from the above values.

In addition to the use of a single preservative material, with a single injection method and apparatus for the preservation of steel and masonry structures as indicated above, it is within the scope of this invention to provide apparatus for using two different and separate liquid preservative materials, one for protecting steel reinforcing members and the other for granular masonry structure. This would be accomplished by modifying the apparatus described above to provide another liquid reservoir and control means located between the reservoirs for selective delivery of each liquid preservative material, as required, to two separate liquid manifolds 22. This operation would use two separate blasts of air from either one or two air manifolds 20, one blast around the first liquid manifold 22 to inject the liquid deeply into structure 10 to coat its structural steel or reinforcing members, and a second blast of a lesser velocity to inject the other liquid from the second liquid manifold less deeply into the structure, so as to coat the surfaces of the intersticies of the granular masonry material of the structure. An intermediate blast of air may be required to cleanse and free the surfaces of the intersticies of the masonry granular particles from any excess steel preservative material which might still remain. Alternatively, a cleansing material may be incorporated into the masonry liquid preservative, thereby eliminating the need for an intermediate blast of cleansing air.

When using the apparatus of this invention for application of liquid preservative to wood structures, the compressed air velocity forces may be reduced 25–45% and the liquid velocity by 20% or until no run-off of liquid occurs during an application time of 2–3 seconds. Following this deep penetration of wood, the treated surfaces may be coated conventionally with paint or vanish to achieve a desired color or decorative effect.

The ranges of viscosities, velocities and times cited above are intended to be illustrative and instructive; it is clear that the type of porous material being treated and the conditions prevailing during the treatment will govern the selection of the optimum most effective operating parameters.

Reference is made to U.S. Pat. No. 5,413,808, issued May 9, 1995. The method-claiming parent to this application, wherein a detailed exposition and full discussion of the technologies involved in the use of this apparatus for practicing this invention is presented, along with full explanation of the effectiveness of the treatment resulting therefrom for long-range protection against the ravages of moisture, air pollutants, acid rain, internal stresses causing cracks and delaminations, freeze-thaw cycles and thermal expansion, chemical and electrolytic corrosion, oxidation, etc., energy loss and graffiti.

The broad concepts and specific embodiments of the best apparatus now contemplated for practicing the invention have been disclosed; it is understood that modifications, substitutions and variations may be made without departing from the concepts of this invention, which are limited and defined only by the scope of the ensuing claims, wherein:

What is claimed is:

1. Apparatus for injecting a liquid preservative material to a substantial depth into porous structures above and below ground without damaging the surfaces of the structures, said porous structures including masonry, concrete, brick, stone, marble and wood, as well as those structures with steel reinforcement members embedded therein, for prolonging the structures' life against attack by acid rain, erosion, aging and decay, which comprises:

at least one supply reservoir of liquid preservative material fluidly connected to a means for applying said liquid preservative material having a plurality of spaced orifices;

means for pumping said liquid preservative material from said supply reservoir through said plurality of spaced orifices in said means for applying said liquid preservative material, to an exposed surface of a structure being treated; and an air compressor supplying high-velocity compressed air and fluidly connected to a means for applying said high-velocity compressed air to said exposed surface being treated, said means for applying said high-velocity compressed air having a plurality of spaced orifices;

wherein the respective orifices of said means for applying said liquid preservative material and said means for applying said high-velocity compressed air being so positioned with respect to each other that said liquid preservative material and the high-velocity compressed air are each directed separately to reach the same area of said surface being treated at substantially the same time, whereby said liquid preservative material and said high-velocity compressed air do not mix until reaching the surface being treated, and whereby said liquid preservative material is deposited in liquid form on said surfaces being treated and is atomized by said high-velocity compressed air acting as a fluid hammer, injecting and driving said atomized liquid preservative to penetrate to a preselected depth into said porous structure beneath said surface being treated.

2. Apparatus as defined in claim 1, wherein said means for applying high-velocity compressed air is so positioned with respect to said means for applying liquid preservative that said high-velocity air blast from said spaced orifices in said means for applying high-velocity compressed air flows around said means for for applying liquid preservative and impinges on said surface being treated in substantially the same area at the same time as said liquid preservative material is deposited on said surface.

3. Apparatus as defined in claim 1, wherein said means for applying liquid preservative material comprises at least one liquid manifold having a nozzle mounted in and extending from each of said spaced orifices for directing and applying liquid preservative material on said exposed surface of a structure to be treated, and wherein said means for applying high-velocity compressed air comprises at least one high-velocity compressed air manifold having a nozzle mounted in and extending from each of said spaced orifices for directing said high-velocity air blast to act as a fluid hammer to atomize, inject and drive said liquid preservative material to a preselected depth below said surface of said porous structure being treated.

4. Apparatus as defined in claim 3, wherein said means for applying liquid preservative material comprises at least one longitudinally-extending liquid manifold having said orifices and said nozzles laterally spaced and positioned along the length thereof for applying said liquid preservative material evenly on said exposed surface of said porous structure to be treated, and wherein said means for applying high-velocity compressed air comprises at least one longitudinally-extending high-velocity compressed air manifold having said orifices and said nozzles laterally spaced and positioned along the length thereof for providing high-velocity compressed air acting as a fluid hammer to atomize, inject and drive said liquid preservative material below said surface of said porous structure being treated to a preselected depth.

5. Apparatus as defined in claim 3, wherein said at least one liquid manifold and said at least one high-velocity compressed air manifold each comprises a plurality and said means for applying liquid preservative material also comprises a plurality, whereby liquid preservative materials of differing composition, differing viscosities and differing penetrative characteristics may be applied selectively during the operation of the apparatus to meet best the demands of changing porosities in said porous structures being treated and of changing weather conditions.

6. Apparatus as defined in claim 5, wherein said plurality of liquid manifolds and said plurality of high-velocity compressed air manifolds comprise a plurality of sets of combined means for applying liquid preservative and means for applying high-velocity compressed air, each of said plurality of sets being positioned on said carrier to apply successive treatments of said liquid preservative under pressure and said high-velocity compressed air to the same area of said exposed surface of said porous structure to be treated sequentially as said carrier is moved selectively during operation of the apparatus.

7. Apparatus as defined in claim 6, wherein the depth of penetration into said structures being impregnated by said successive treatments may be varied selectively by adjustment of, for each of said plurality of sets, at least one of the following, selected from the group consisting of the distance between said surface being treated and said nozzles in said liquid and said air manifolds, the composition of said liquid preservative material, the viscosity of said liquid preservative material, the temperature of said liquid preservative material, the uninterrupted smooth delivery of said liquid preservative to said surface of said structure being treated, the pulsing intermittent delivery of said liquid preservative material to said surface of said structure being treated, the velocity of said high-velocity compressed air blast, the temperature of said high-velocity compressed air blast, the uninterrupted smooth delivery of said high-velocity compressed air blast to the surface of said structure being treated and the intermittent pulsating delivery of said high-velocity compressed air blast to said surface of said structure being treated.

8. Apparatus as defined in claim 1, further comprising carrier means having said means for applying liquid preservative material and said means for applying high-velocity compressed air both mounted thereon.

9. Apparatus as defined in claim 8, wherein said carrier means has mounted thereon said means for pumping said liquid preservative material and said fluid connecting means between said supply reservoir and said means for applying liquid preservative material, as well as said fluid connecting means between said air compressor and said means for applying high-velocity compressed air.

10. Apparatus as defined in claim 9, wherein said carrier further comprises means for moving said carrier in any direction, and means for directing said liquid preservative material stream and said high-velocity compressed air blast against an exposed surface of any orientation on said porous structure to be treated.

11. Apparatus as defined in claim 10, wherein said carrier moving means and said liquid- and air-directing means are actuated and operated by means selected from the group consisting of manual means, mechanical hand-controlled means, robotic remote-controlled means and any combination thereof.

12. Apparatus as defined in claim 10, wherein said at least one liquid manifold and said at least one high-velocity compressed air manifold are positioned adjustably with respect to said surface being treated to achieve maximum effectiveness and control of liquid penetration into said porous structure.

13. Apparatus as defined in claim 1, wherein said means for pumping said liquid preservative material from said supply reservoir through said plurality of spaced orifices in said means for applying said liquid preservative material can deliver said liquid preservative material in a form selected from the group consisting of a pure liquid stream and a stream comprising said liquid preservative material admixed with a quantity of low-velocity compressed air sufficient to enhance and adjust the delivery of said liquid preservative material to said surface of said porous structure being treated.

14. Apparatus as defined in claim 1, wherein said air compressor supplying high-velocity compressed air and fluidly connected to said means for applying said high-velocity compressed air can provide said high-velocity compressed air in a form selected from the group consisting of a continuous air blast and intermittent pulsating air blasts.

15. Apparatus as defined in claim 1, further comprising a shroud covering both said means for applying liquid preservative material and said means for applying high-velocity compressed air except for the area directly facing said spaced orifices.

16. Apparatus as defined in claim 1, wherein said fluid connecting means between said supply reservoir and said means for applying said liquid preservative material, and said fluid connecting means between said air compressor and said means for applying said high-velocity compressed air, further comprise control means for regulating the temperature of said liquid preservative material and said high-velocity compressed air, whereby weather conditions affecting the physical characteristics and penetrating ability of said liquid preservative material and changing porosities of the structure being treated may be counteracted to achieve the desired penetration depth of the treatment.

17. Apparatus as defined in claim 1, wherein said liquid preservative material comprises a polymeric resin.

18. Apparatus as defined in claim 1, wherein said liquid preservative material is selected from the group consisting of acrylic resins, polyurethane resins, epoxy resins, silane polymers and petroleum hydrocarbons.

19. Apparatus as defined in claim 1, wherein said air compressor fluidly connected to said means for applying said high-velocity compressed air delivers said high-velocity compressed air in a wide range of velocities to meet the varying factors of structural porosity, liquid viscosity and ambient temperature and humidity.

* * * * *